US006112392A

United States Patent [19]

Becker et al.

[11] Patent Number: 6,112,392

[45] Date of Patent: Sep. 5, 2000

[54] METHOD AND APPARATUS FOR INSTALLING A CANOPY TO A ROLLER TUBE

[75] Inventors: Kent Becker, Huntertown; Robert Anderson, Lagrange, both of Ind.

[73] Assignee: White Consolidated Industries, Inc., Cleveland, Ohio

[21] Appl. No.: 09/015,137

[22] Filed: Jan. 29, 1998

[51] Int. Cl.[7] ..... B25B 27/14

[52] U.S. Cl. ..... 29/281.5; 29/271; 29/283

[58] Field of Search ..... 257/134.3 FT, 257/134.3 R; 160/393, 396; 29/241, 283, 271, 281.5

[56] References Cited

U.S. PATENT DOCUMENTS

| | | | |
|---|---|---|---|
| D. 309,280 | 7/1990 | Balfanz-Lee | D11/215 |
| 669,776 | 3/1901 | Beam . | |
| 706,315 | 8/1902 | Greene . | |
| 3,918,510 | 11/1975 | Hayward . | |
| 4,033,397 | 7/1977 | McKee . | |
| 4,258,778 | 3/1981 | Upton et al. . | |
| 5,002,111 | 3/1991 | Boiteau . | |
| 5,351,736 | 10/1994 | Laffler et al. . | |

*Primary Examiner*—David A. Scherbel
*Assistant Examiner*—Lee Wilson
*Attorney, Agent, or Firm*—Pearne & Gordon LLP

[57] ABSTRACT

A guide and a method of using the guide to install a spline of a canopy in a channel formed in a side wall of a roller tube having an end with a circumferential edge. The guide has an interior groove formed therein for receiving a portion of the circumferential edge so as to mount the guide to the roller tube. A wall of the guide covers the circumferential edge and defines a mounting opening. When the guide is mounted to the roller tube, the mounting opening is disposed over an end of the channel so as to permit the spline to be moved through the mounting opening and into the channel. The wall may define a second mounting opening for disposal over an end of a second channel formed in the side wall of the roller tube.

18 Claims, 4 Drawing Sheets

METHOD AND APPARATUS FOR INSTALLING A CANOPY TO A ROLLER TUBE

BACKGROUND OF THE INVENTION

This invention relates to retractable awnings in general and, more particularly, to a guide for installing a canopy to a roller tube of a retractable awning.

A conventional retractable awning includes a fabric canopy having an outer portion secured to a roller tube, and an inner portion secured to a vertical wall of a building or a moving structure such as a recreational vehicle. The roller tube is supported at its ends for movement between a retracted position, wherein the roller tube is disposed adjacent to the wall and an extended position, wherein the roller tube is spaced from the wall. When the roller tube is in the retracted position, the canopy is rolled up around the roller tube so as to form an awning roll. When the roller tube is in the extended position, the canopy is unrolled from the roller tube and extends between the wall and the roller tube.

The roller tube is generally cylindrical and has opposing open ends with circumferential edges. Typically, a plurality of channels are formed in the roller tube and extend the length thereof. The channels are equally spaced around the perimeter of the roller tube and often have a triangular cross-section. An example of such a roller tube is shown in U.S. Pat. No. 5,351,736 to Laffler et al., which is assigned to the assignee of the present invention and is hereby incorporated by reference.

The outer end of the canopy is secured to the roller tube by a spline that is received in one of the channels of the roller tube. Typically, the spline is comprised of a piece of rope secured inside a sleeve that is sewn into the canopy.

In order to secure the canopy to the roller tube, an operator inserts the spline into an end of one of the channels and then pulls a leading end of the roller tube onto the canopy while holding the canopy stationary. Once the roller tube is centered on the canopy, the operator stops pulling the roller tube onto the canopy.

As the roller tube moves over the canopy, the circumferential edge of the leading end of the roller tube scrapes against the canopy. If the circumferential edge is rough, the circumferential edge may tear the canopy, which is undesirable. Accordingly, there is a need in the art for a method and apparatus for preventing a canopy from being damaged as it is mounted to a roller tube. The present invention is directed to such a method and apparatus.

SUMMARY OF THE INVENTION

It therefore would be desirable, and is an advantage of the present invention, to provide an apparatus for preventing a canopy from being damaged as it is mounted to a roller tube. In accordance with the present invention, a guide is provided for installing a spline of a canopy in a channel formed in a side wall of a roller tube having an end with a circumferential edge. The channel extends the length of the side wall and has a longitudinal opening and an open end. The guide includes a first surface and a wall with a second surface. The first surface defines a groove adapted to receive a portion of the circumferential edge so as to mount the guide to the roller tube. The second surface is disposed over the groove. The wall defines a mounting opening which may be disposed over the end of the channel when the guide is mounted to the roller tube so as to permit the spline to be moved through the mounting opening and into the channel.

Also provided in accordance with the present invention is a guide having first and second walls. The first wall is for disposal adjacent to the side wall of the roller tube. The second wall is for covering a portion of the circumferential edge. The second wall is joined to the first wall and defines a mounting opening which may be disposed over the end of the channel when the first wall is disposed adjacent to the side wall so as to permit the spline to be moved through the mounting opening and into the channel.

Also provided in accordance with the present invention is a method of forming an awning assembly. In accordance with the method, a canopy, a roller tube, and a guide are selected. The canopy has an outer portion with a spline. The roller tube has an end with a circumferential edge and a side wall with a channel formed therein. The channel extends the length of the side wall and has a longitudinal opening and an open end. The guide has a first surface and a wall with a second surface. The first surface defines a groove disposed below the second surface, and the wall defines a mounting opening. The guide is disposed over the end of the roller tube such that a portion of the circumferential edge is received in the groove and the mounting opening is disposed over the end of the channel. The spline of the canopy is inserted through the mounting opening and into the channel, and the roller tube is pulled onto the canopy.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
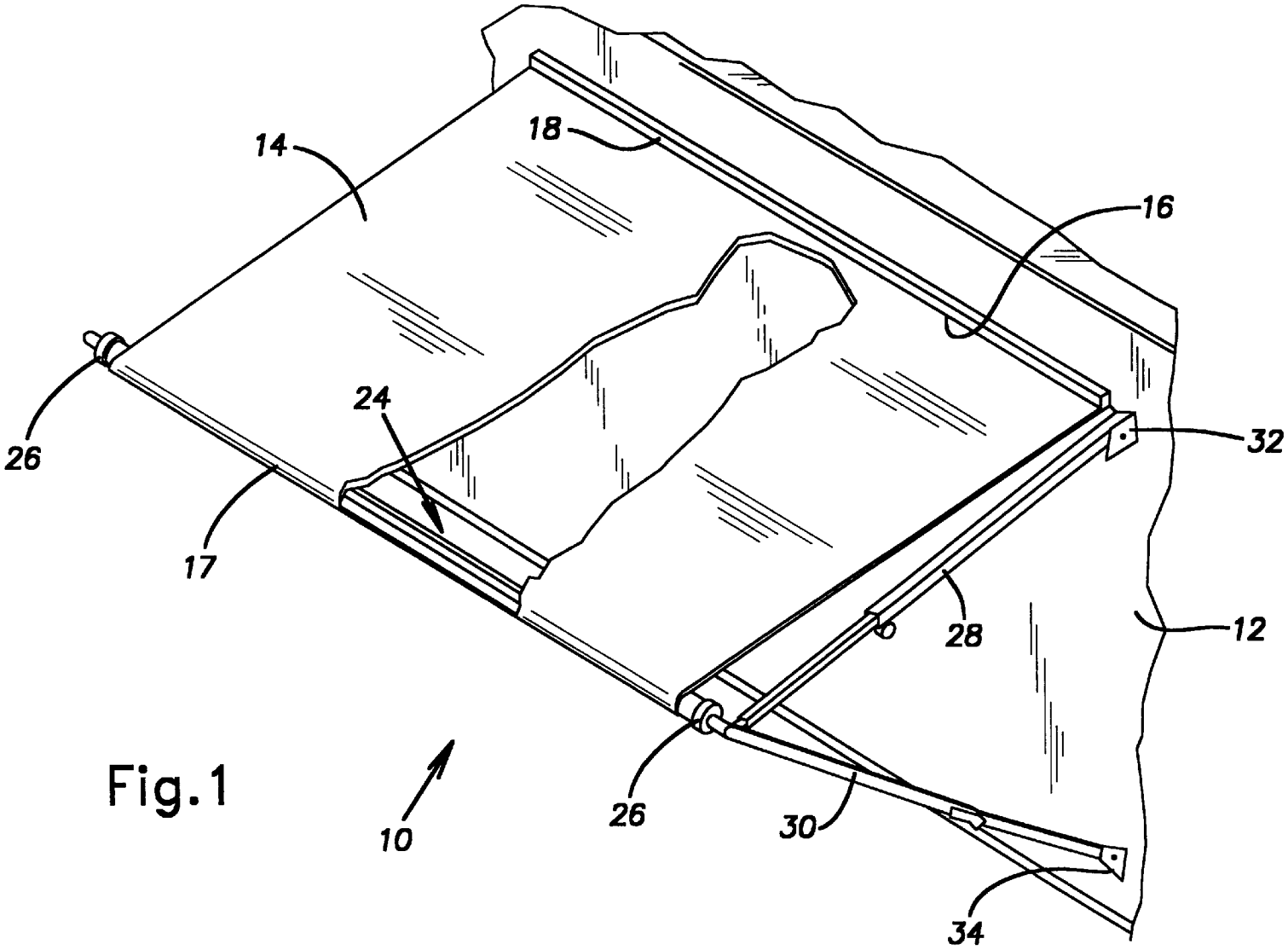
FIG. 1 shows a perspective view of an awning assembly having a roller tube.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Referring now to FIG. 1, there is shown a perspective view of an awning assembly 10 in an extended or employed position. The awning assembly 10 is mounted to a wall 12 of a structure, such as a recreational vehicle. The awning assembly 10 includes a rectangular canopy 14 composed of a fabric material. The canopy 14 has an inner portion 16 secured to a rail 18 mounted on an upper portion of the wall 12 of the vehicle, and an outer portion 17 with inner and outer splines 20, 22 (shown in FIG. 2). The inner and outer splines 20, 22 are secured to a roller tube 24 having opposing end portions fitted with caps 26.

Each end portion of the roller tube 24 is supported by an extensible arm 28 and an extensible leg 30. The arms 28 have outer ends connected to the caps 26 of the roller tube 24, and inner ends pivotally secured to upper brackets 32 mounted on the wall 12 of the vehicle at a position close to the attachment line of the canopy 14. The legs 30 have outer ends connected to the caps 26 of the roller tube 24, and inner ends pivotally secured to lower brackets 34 mounted on the wall 12 at a position lower than the upper brackets 32. The arms 28, the legs 30, and the upper and lower brackets 32, 34 form a support structure that supports the roller tube 24 for movement relative to the wall 12.

When the awning assembly 10 is in the employed position, the roller tube 24 is spaced from the wall 12 and the canopy 14 is stretched out between the roller tube 24 and the wall 12. When the awning assembly 10 is in a stored position, the canopy 14 is rolled up around the roller tube 24 so as to form an awning roll (not shown), which is supported adjacent to the wall 12.

Figure 2:
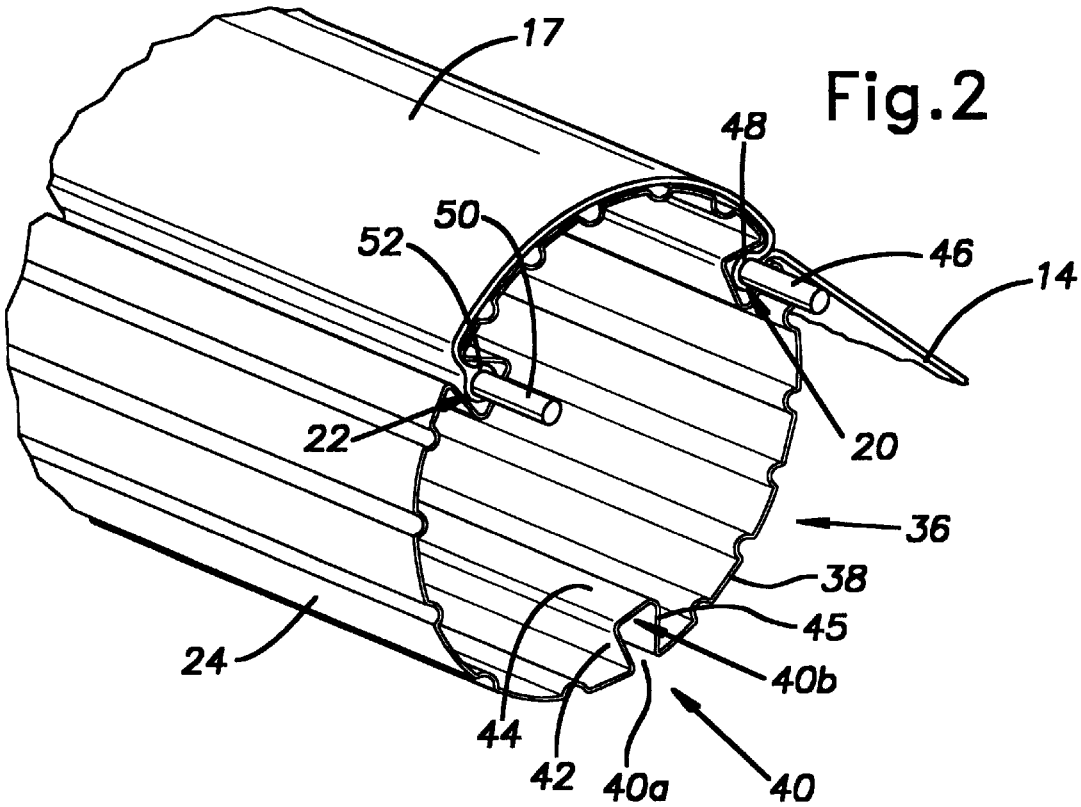
FIG. 2 shows a perspective view of the roller tube with a canopy attached thereto.

Referring now to FIG. 2, there is shown a perspective view of the roller tube 24 with the canopy 14 attached thereto. The roller tube 24 is preferably formed from a sheet of steel that has been galvanized and coated to resist corrosion. The sheet is configured to provide the roller tube 24 with a substantially cylindrical shape as shown in FIG. 2, or a generally cylindrical shape comprised of a plurality of flat sides forming an octagon or other multi-sided shape. The roller tube 24 has opposing open ends 36, each with a circumferential edge 38.

A plurality of slideways 40 are formed in the roller tube 24 and extend the length thereof. Preferably, three slideways 40 are symmetrically spaced around the circumference of the roller tube 24. Each slideway 40 has opposing open ends, a longitudinal opening 40*a*, and an inner channel 40*b*. The channel 40*b* has a width greater than the longitudinal opening 40*a* and is defined by two side walls 42 and a base wall 44 arranged to provide the channel 40*b* with a trapezoidal or generally triangular cross-section. Alternatively, the channel 40*b* could be formed to have another cross-sectional shape, such as a rectangle or a semi-circle. The primary limitation on the cross-section of the channel 40*b* is that it should have a configuration adapted to slidably receive a piece of rope having a diameter larger than the width of the longitudinal opening 40*a*. The ends of the slideways 40 have generally triangular edges 45 that form radially-inner portions of the circumferential edge 38.

The inner and outer splines 20, 22 of the canopy are disposed in adjacent slideways 40 of the roller tube 24. The outer spline 22 is comprised of an outer rope 50 secured in an outer sleeve 52, which is sewn into the outer portion 17 of the canopy 14. Similarly, the inner spline 20 is comprised of an inner rope 46 secured in an inner sleeve 48, which is sewn into the outer portion 17 of the canopy 14. Each of the inner and outer ropes 46, 50 is flexible and has a circular cross-section. The outer rope 50 has opposing end portions, each of which protrudes out of the outer sleeve 52 and extends away from the canopy 14 for a distance. Similarly, the inner rope 46 has opposing end portions, each of which protrudes out of the inner sleeve 48 and extends away from the canopy 14 for a distance.

The inner and outer splines 20, 22 have diameters larger than the width of the longitudinal openings 40*a*, thereby precluding the inner and outer splines 20, 22 from being pulled out of the slideways 40 through the longitudinal openings 40*a*. The inner and outer splines 20, 22 are installed inside the slideways 40 by threading them through the open ends of the slideways 40 using one or more mounting guides embodied in accordance with the present invention.

It should be appreciated that the inner and outer splines 20, 22 are not limited to the structure described above. The inner and outer splines 20, 22 may have any structure that provides the canopy 14 with elongated-ridges or protuberances that extend along the width of the outer portion 17 of the canopy 14. For example, wooden dowels may be sewn into the inner and outer sleeves 48, 52 in lieu of the inner and outer ropes 46, 59.

Figure 3:
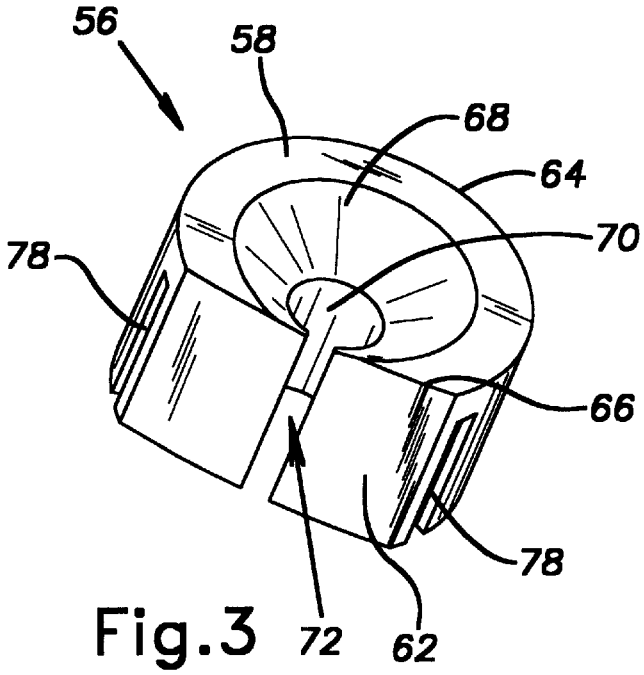
FIG. 3 shows a top perspective view of one of a pair of mounting guides constructed in accordance with a first embodiment of the present invention.

Referring now to FIG. 3, there is shown a top perspective view of a mounting guide 56 provided in accordance with a first embodiment of the present invention. The mounting guide 56 is generally semi-cylindrical and is preferably composed of injection-molded plastic or molded wood pulp. The mounting guide is hollow and includes a top wall 58, a semi-cylindrical rear wall 60 (shown best in FIG. 4), and a slightly arcuate front wall 62. The top wall 58 is integrally joined to the rear wall 60 along an arcuate rear edge 64 and is integrally joined to the front wall 62 along an arcuate front edge 66. The rear wall 60 extends downwardly from the rear edge 64 at a substantially right angle to the top wall 58. Similarly, the front wall 62 extends downwardly from the front edge 66 at a substantially right angle to the top wall 58. The top wall 58, the rear wall 60, and the front wall 62 each have a smooth exterior surface. A parabolic depression 68 is formed in the exterior surface of the top wall 58, toward the center thereof.

A top or first opening 70 extends through the top wall 58, toward the center of the depression 68. A front or second opening 72 extends through the front wall 62 and into the first opening 70. The second opening 72 extends the height of the front wall 62.

The first opening 70 is generally circular, while the second opening 72 is generally rectangular. Alternatively, the first opening 70 can be formed to have another shape, such as a rectangle or a triangle. The first opening 70 is sized to allow the inner spline 20 and the outer spline 22 to individually slide therethrough. The width of the second opening 72, however, is smaller than the diameter of the inner and outer splines 20, 22 so as to prevent either the inner spline 20 or the outer spline 22 to be moved through the second opening 72.

Figure 4:
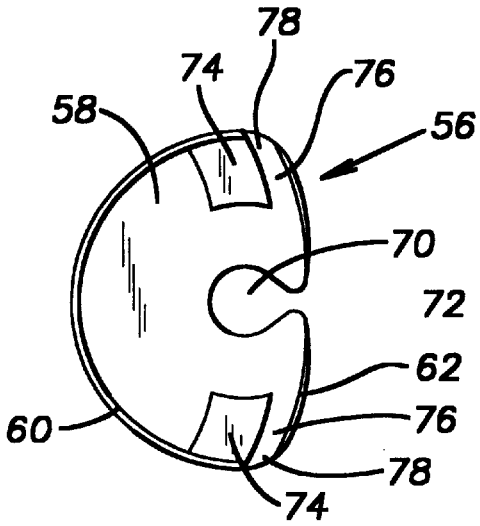
FIG. 4 shows a bottom view of one of the mounting guides of the first embodiment.

Referring now to FIG. 4, there is shown a bottom view of the mounting guide 56. The mounting guide 56 has an interior surface defined by interior surfaces of the top wall 58 and the front wall 62, and by front surfaces on a pair of arcuate blocks 74. The interior surface of the mounting guide 56 defines a narrow groove 76 for receiving a portion of the circumferential edge 38 of the roller tube 24.

The blocks 74 are joined to an interior surface of the top wall 58. Each of the blocks 74 arcuately extends from just outward of the depression 68 to the interior surface of the rear wall 60. The blocks 74 project downwardly for approximately half of the height of the mounting guide 56. The blocks 74 are spaced just inward from the interior surface of the front wall 62 so as to define the groove 76 therebetween. The arcuate shape of the blocks 74 and the front wall 62 provide the groove 76 with an arcuate shape that corresponds to the arc of the circumferential edge 38 of the roller tube 24. In addition, the groove 76 is sized to have a width approximately the same as the thickness of the metal sheet comprising the roller tube 24. In this manner, the groove 76 is adapted to snugly receive a portion of the circumferential edge 38 of the roller tube 24. The groove 76 extends through openings 78 in opposing portions of the rear wall 60 that adjoin the front wall 62.

In order to install the inner and outer splines 20, 22 of the canopy 14 inside the slideways 40 of the roller tube 24, a pair of the mounting guides 56 are mounted to an end 36 of the roller tube 24, over the ends of two adjacent slideways 40. Each mounting guide 56 is mounted to the end 36 of the roller tube 24 by positioning the mounting guide 56 over the roller tube 24 such that the first opening 70 is aligned with the end of the slideway 40 and such that the groove 76 is aligned with the circumferential edge 38 of the roller tube 24. The mounting guide 56 is then pressed onto the roller tube 24 such that portions of the circumferential edge 38 on opposing sides of the slideway 40 snap into the groove 76 and become securely disposed therein.

Figure 5:
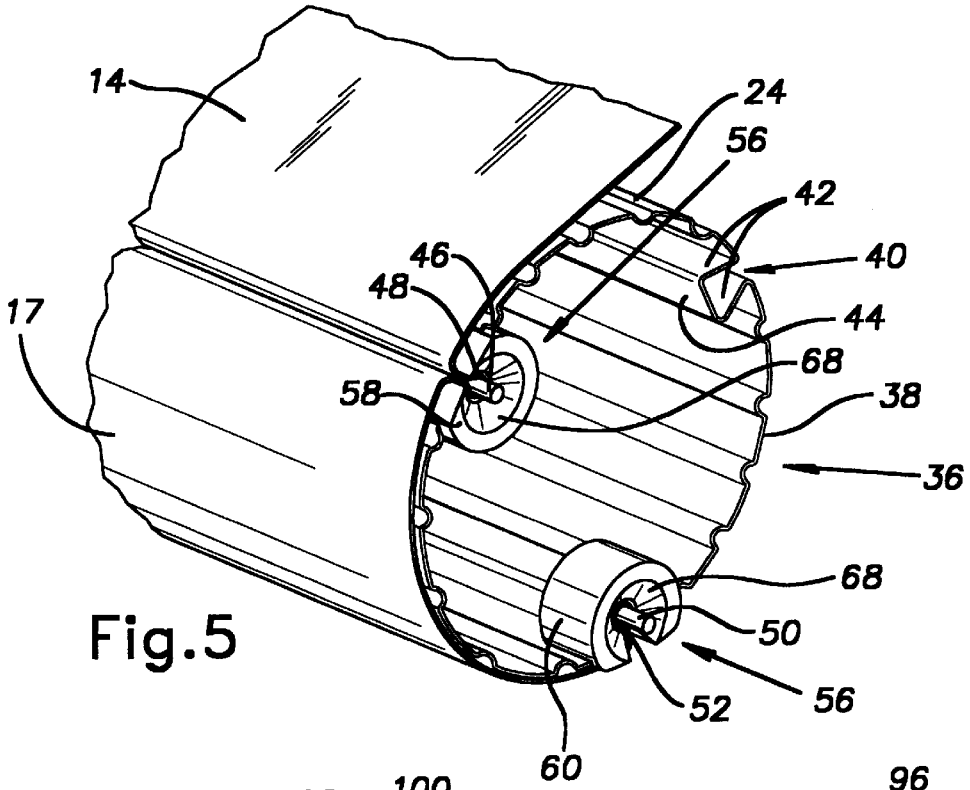
FIG. 5 shows a perspective view of the roller tube with the canopy and the mounting guides of the first embodiment mounted thereto.

Referring now to FIG. 5, the mounting guides 56 are shown mounted to the roller tube 24. With regard to each mounting guide 56 and its respective slideway 40, the top wall 58 covers the triangular edge 45 of the slideway 40, as well as the portions of the circumferential edge 38 that are disposed in the groove 76. In addition, the first opening 70 of the mounting guide 56 is aligned over the channel 40*b* of the slideway 40 and the second opening 72 of the mounting guide 56 is aligned over the longitudinal opening 40*a* of the slideway 40. The circumferential edge 38 of the roller tube 24 extends through the openings 78 in the rear wall 60 of the mounting guide 56, and the interior surface of the front wall 62 of the mounting guide 56 is disposed adjacent to an exterior surface of the roller tube 24.

After the mounting guides 56 are mounted to the roller tube 24 over their respective slideways 40, the end portions of the inner and outer ropes 46, 50 are inserted into the ends of the slideways 40 through the first openings 70 in the mounting guides 56. The inner and outer ropes 46, 50 are moved through the slideways 40 until the inner and outer splines 20, 22 enter the first openings 70, and side edge portions of the canopy 14 enter the second openings 72. The roller tube 24 is then pulled onto the canopy 14, while the canopy 14 is held stationary. As the roller tube 24 is pulled onto the canopy 14, the mounting guides 56 move over the canopy 14 and the channels 40*b* of the slideways move 40 over the inner and outer splines 20, 22. The depressions 68 of the end walls 58 help guide the channels 40*a* of the slideways 40 over the inner and outer splines 20, 22.

The farther the roller tube 24 is pulled onto the canopy 14, the farther the inner and outer splines 20, 22 become disposed in the channels 40*a* of the slideways 40, and the farther the side edge portions of the canopy 14 become disposed in the longitudinal openings 40*a* of the slideways 40. When the roller tube 24 is centered on the canopy 14, the pulling of the roller tube 24 ceases. The mounting guides 56 are then removed from the end 36 of the roller tube 24, thereby completing the mounting of the canopy 14 to the roller tube 24.

It should be appreciated from the foregoing description of the construction and operation of the mounting guide 56 that the mounting guide 56 prevents the canopy 14 from being torn when the roller tube 24 is pulled onto the canopy 14. The mounting guide 56 covers the portions of the circumferential edge 38 that would otherwise contact the canopy 14 when the roller tube 24 is pulled onto the canopy 14. Thus, the mounting guide 56 slides over the canopy 14, rather than the narrow circumferential edge 38 of the roller tube 24. Since the mounting guide 56 has smooth exterior surfaces and rounded edges, the mounting guide 56 will glide over the canopy 14 without scratching or tearing the canopy 14.

Figure 6:
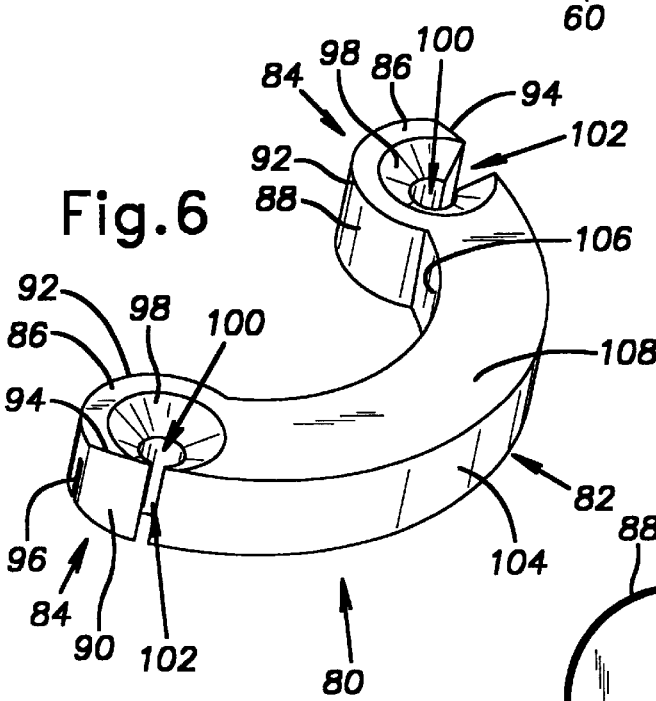
FIG. 6 shows a top perspective view of a mounting guide constructed in accordance with a second embodiment of the present invention.

Referring now to FIG. 6, there is shown a perspective view of a mounting guide 80 provided in accordance with a second embodiment of the present invention. The mounting guide 80 is generally C-shaped and is preferably composed of injection-molded plastic or molded wood pulp. The mounting guide 80 includes an arcuate body 82 joined between a pair of installation nodes 84. Preferably, the mounting guide 80 is formed as one integral unit.

Each of the installation nodes 84 has a construction similar to the mounting guide 56 of the first embodiment and includes a top wall 86, an arcuate rear wall 88, and a slightly arcuate front wall 90. The top wall 86 is integrally joined to the rear wall 88 along an arcuate rear edge 92 and is integrally joined to the front wall 90 along a slightly arcuate front edge 94. The rear wall 88 extends downwardly from the rear edge 92 at a substantially right angle to the top wall 86. Similarly, the front wall 90 extends downwardly from the front edge 94 at a substantially right angle to the top wall 86. The top wall 86, the rear wall 88, and the front wall 90 each have a smooth exterior surface. An opening 96 is formed in the rear wall 88, proximate to the front wall 90.

In each of the installation nodes 84, a parabolic depression 98 is formed in the exterior surface of the top wall 86, toward the center thereof. An end or first opening 100 extends through the top wall 86, toward the center of the depression 98. A front or second opening 102 extends through the front wall and into the first opening 100. The second opening 102 extends along the height of the front wall 90. Preferably, the first opening 100 is generally circular and the second opening 102 is generally rectangular. The first opening 100 is sized to allow the inner spline 20 and the outer spline 22 to individually slide therethrough. The width of the second opening 102, however, is smaller than the diameter of the inner and outer splines 20, 22 so as to prevent either the first spline 20 or the second spline 22 to move through the second opening 102.

The body 82 includes an arcuate front wall 104, an arcuate rear wall 106, and a top wall 108. The rear wall 106 extends between the rear walls 88 of the installation nodes 84, while the front wall 104 extends between the front walls 90 of the installation nodes 84. The top wall 108 is seemlessly joined between the top walls 86 of the installation nodes 84.

Figure 7:
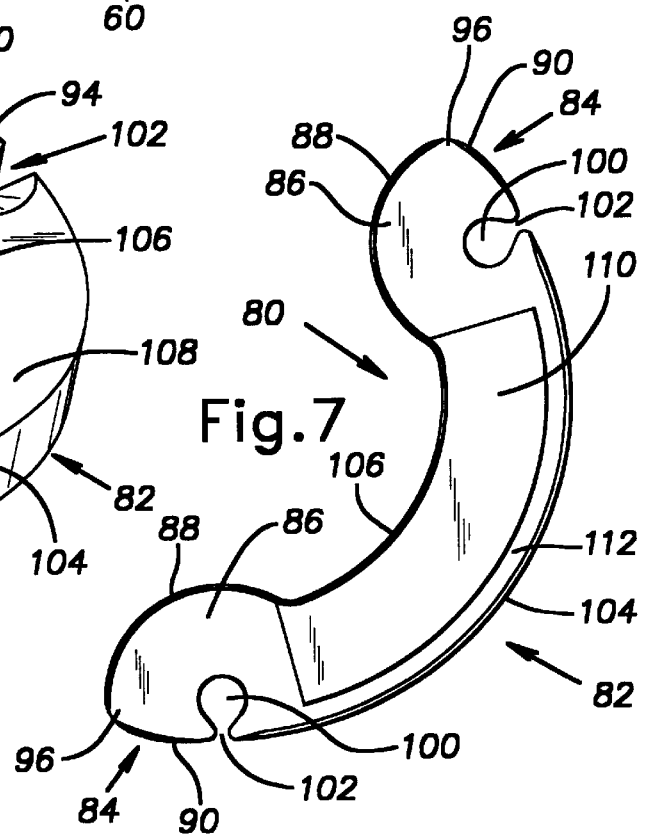
FIG. 7 shows a bottom view of the mounting guide of the second embodiment.

Referring now to FIG. 7, there is shown a bottom view of the mounting guide 80. The body 82 of the mounting guide 80 has an interior surface defined by interior surfaces of the top wall 108 and the front wall 104, and by a front surface on an interior block 110. The interior surface defines a narrow groove 112 for receiving a portion of the circumferential edge of the roller tube 24.

The block 110 is joined to an interior surface of the top wall 108 of the body 82. The block 110 arcuately extends along the length of the rear wall 106 and projects downwardly for approximately half of the height of the front and rear walls 104, 106. The block 110 is spaced just inward from the interior surface of the front wall 104 so as to define the groove 112 therebetween. The arcuate shape of the block 110 and the front wall 104 provides the groove 112 with an arcuate shape that corresponds to the arc of the circumferential edge 38 of the roller tube 24. In addition, the groove 112 is sized to have a width approximately the same as the thickness of the metal sheet comprising the roller tube 24. In this manner, the groove 112 is adapted to snugly receive a portion of the circumferential edge 38 of the roller tube 24.

The mounting guide 80 is mounted to an end 36 of the roller tube 24, over the ends of two adjacent slideways 40. The mounting guide 80 is mounted to the end 36 of the roller tube 24 by positioning the mounting guide 80 over the roller tube 24 such that the first openings 100 are aligned with the ends of the slideways 40 and such that the groove 112 is aligned with a portion of the circumferential edge 38 located between the slideways 40. The mounting guide 80 is then pressed onto the roller tube 24 such that the circumferential edge 38 snaps into the groove 112 and becomes securely disposed therein.

Although not shown, when the mounting guide 80 is mounted to the roller tube 24, the top walls 86 of the installation nodes 84 cover the triangular edges 45 of the slideways 40. In addition, the top walls 86 of the installation nodes 84 and the top wall 108 of the body 82 cover the portion of the circumferential edge 38 that extends through the mounting guide 80. Also, the first openings 84 of the installation nodes 84 are aligned over the channels 40*b* of the slideways 40 and the second openings 102 of the installation nodes 84 are aligned over the longitudinal openings 40*a* of the slideways 40. The circumferential edge 38 of the roller tube 24 extends through the openings 96 in the rear walls 88 of the installation nodes 84. The interior surface of the front wall 104 of the body 82 and the interior surfaces of the front walls 90 of the installation nodes 84 are disposed adjacent to an exterior surface of the roller tube 24.

It should be appreciated that the roller tube 24 is mounted to the canopy 14 in substantially the same manner when the mounting guide 80 is used as when the mounting guide 56 is used. It should also be appreciated that the mounting guide 80 provides substantially the same benefits as the mounting guide 56.

Figure 8:
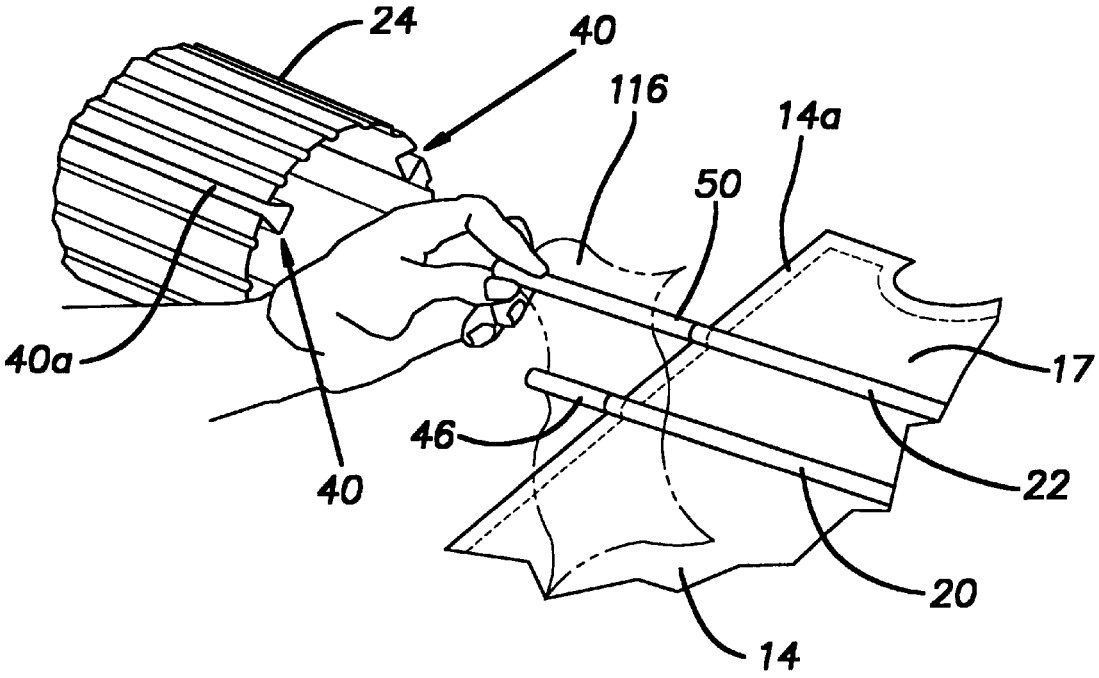

In lieu of mounting the roller tube 24 to the canopy 14 using either the mounting guide 56 or the mounting guide 80, the roller tube 24 can be mounted to the canopy 14 using a sheet 116 composed of low-friction material, such a plastic. Referring now to FIG. 8, the sheet 116 is shown being manipulated for use in mounting the roller tube 24 to the canopy 14.

As shown in FIG. 8, end portions of the inner and outer ropes 46, 50 are cut so as to make the end portion of the outer rope 50 longer than the end portion of the inner rope 46. Preferably the end portion of the outer rope 50 has a length of about 4.5 inches and the end portion of the inner rope 46 has a length of about 3.5 inches. The sheet 116 is placed at an angle over the end portions of the inner and outer ropes 46, 50. The sheet 116 is pinched around the end portion of the outer rope 50, and the outer rope 50 is inserted between one and two inches into the end of one of the slideways 40 in the roller tube 24. The sheet 116 is then pinched around the end portion of the inner rope 46, and the end portion of the inner rope 46 is inserted between one and two inches into the end portion of an adjacent slideway 40.

After the inner and outer ropes 46, 50 are started in the slideways 40 as described above, the roller tube 24 is pulled onto the canopy 14 until the roller tube 24 reaches a side hem 14*a* of the canopy 14. The canopy 14 and the sheet 116 are then tucked into the slideways 40 and around the roller tube 24 until the roller tube 24 can slide over the side hem 14*a*. The roller tube 24 is then pulled onto the canopy 14, while the canopy 14 is held stationary. As the roller tube 24 is pulled onto the canopy 14, the sheet 116 acts as a funnel to guide the canopy 14 into the slideways 40 without letting the canopy 14 touch the circumferential edge 38 of the roller tube 24.

The roller tube 24 is pulled onto the canopy 14 until the roller tube 24 is centered on the canopy 14. Once the roller tube 24 is centered, the sheet 116 is pulled off and discarded.

Although the preferred embodiments of this invention have been shown and described, it should be understood that various modifications and rearrangements of the parts may be resorted to without departing from the scope of the invention as disclosed and claimed herein.

What is claimed is:

1. A roller tube and guide assembly for installing a spline of a canopy, comprising:

a roller tube having an end, said end of the roller tube having a circumferential edge;

a channel formed in, and extending the length of, said roller tube and said channel having a longitudinal opening and an open end;

a guide having a first surface defining a groove adapted to receive a portion of the circumferential edge so as to mount the guide to the roller tube, and a second surface adjacent the first surface defining a mounting opening which can be disposed over the end of the channel when the guide is mounted to the roller tube so as to permit the spline to be moved through the mounting opening and into the channel.

2. The roller tube and guide assembly of claim 1 wherein the groove is arcuate.

3. The roller tube and guide assembly of claim 1 wherein the second surface has a depressed portion.

4. The roller tube and guide assembly of claim 3 wherein the mounting opening extends through the depressed portion of the second surface.

5. The roller tube and guide assembly of claim 4 wherein the depressed portion of the second surface is parabolic so as to help direct the spline into the mounting opening.

6. The roller tube and guide assembly of claim 1 further comprising an arcuate front wall joined to the second surface, said front wall defining a front opening which extends into the mounting opening.

7. The roller tube and guide assembly of claim 6 wherein the first surface comprises: an interior surface of the front wall, an interior surface of the second surface, and surfaces on a pair of blocks, said blocks extending downwardly from the interior surface of the second surface and being spaced inwardly from the interior surface of the front wall so as to help define the groove therebetween.

8. The roller tube and guide assembly of claim 6 further comprising an arcuate rear wall joined to the front wall and the second surface.

9. The roller tube and guide assembly of claim 8 wherein the groove extends through openings formed in opposing portions of the rear wall.

10. The roller tube and guide assembly of claim 8 wherein the guide is generally semi-cylindrical.

11. The roller tube and guide assembly of claim 1 wherein the second surface defines a second mounting opening spaced from the first mounting opening.

12. A roller tube and guide assembly for installing a spline of a canopy, comprising:

a roller tube having an end, said end of the roller tube having a circumferential edge;

a channel formed in, and extending the length of, said roller tube and said channel having a longitudinal opening and an open end;

a guide having a first wall for disposal adjacent to the roller tube, and a second wall for covering a portion of the circumferential edge, said second wall being joined to the first wall and defining a mounting opening which may be disposed over the end of the channel when the first wall is disposed adjacent to said roller tube so as to permit the spline to be moved through the mounting opening and into the channel.

13. The roller tube and guide assembly of claim 12 wherein the first wall defines a second opening which extends into the mounting opening, said second opening being disposed over the longitudinal opening of the channel when the mounting opening is disposed over the end of the channel, thereby permitting the canopy to move into the longitudinal opening when the spline is moved into the channel through the mounting opening of the guide.

14. The roller tube and guide assembly of claim 12 further comprising a pair of blocks extending downwardly from an interior surface of the second wall and being spaced inwardly from an interior surface of the first wall so as to define a groove therebetween, said groove being adapted to receive a portion of the circumferential edge so as to mount the guide to the roller tube.

15. The roller tube and guide assembly of claim 14 further comprising an arcuate third wall joined to the first and second walls, said third wall having opposing portions defining openings through which the groove extends.

16. The roller tube and guide assembly of claim 15 wherein the third wall is generally semi-cylindrical.

17. The roller tube and guide assembly of claim 12 wherein the guide is composed of plastic.

18. The roller tube and guide assembly of claim 12 wherein the second wall defines a second mounting opening spaced from the first mounting opening.

* * * * *

UNITED STATES PATENT AND TRADEMARK OFFICE

CERTIFICATE OF CORRECTION

PATENT NO. : 6,112,392

DATED : September 5, 2000

INVENTOR(S) : Becker et al.

It is certified that error appears in the above-indentified patent and that said Letters Patent is hereby corrected as shown below:

Column 2, BRIEF DESCRIPTION OF THE DRAWINGS, after line 50, insert --FIG. 8 shows installation of an awning using a low-friction material sheet.--

Signed and Sealed this

Eighth Day of May, 2001

*Attest:*

Nicholas P. Godici

NICHOLAS P. GODICI

*Attesting Officer*

*Acting Director of the United States Patent and Trademark Office*